US010140798B2

(12) United States Patent
Kondo et al.

(10) Patent No.: US 10,140,798 B2
(45) Date of Patent: Nov. 27, 2018

(54) COIN TUBE

(71) Applicant: NIPPON CONLUX CO., LTD., Sakado-shi (JP)

(72) Inventors: Masashi Kondo, Sakado (JP); Fumio Yuzawa, Sakado (JP); Takahiro Hayashi, Sakado (JP)

(73) Assignee: NIPPON CONLUX CO., LTD., Sakado-shi (JP)

( * ) Notice: Subject to any disclaimer, the term of this patent is extended or adjusted under 35 U.S.C. 154(b) by 0 days.

(21) Appl. No.: 15/537,471

(22) PCT Filed: Dec. 19, 2014

(86) PCT No.: PCT/JP2014/083774

§ 371 (c)(1),
(2) Date: Jun. 19, 2017

(87) PCT Pub. No.: WO2016/098259

PCT Pub. Date: Jun. 23, 2016

(65) Prior Publication Data

US 2017/0352221 A1 Dec. 7, 2017

(51) Int. Cl.

| | |
|---|---|
| ***G07D 9/06*** | (2006.01) |
| ***G07D 3/10*** | (2006.01) |
| ***G07D 9/00*** | (2006.01) |

(52) U.S. Cl.

CPC ..... *G07D 3/10* (2013.01); *G07D 9/00* (2013.01)

(58) Field of Classification Search

CPC ..... G07D 3/10; G07D 9/002; G07D 9/008; G07D 9/06; G07D 11/0018

See application file for complete search history.

(56) References Cited

U.S. PATENT DOCUMENTS

| | | | | |
|---|---|---|---|---|
| 3,265,077 | A * | 8/1966 | Kirkpatrick | G07D 9/06 206/0.84 |
| 4,883,158 | A | 11/1989 | Kobayashi et al. | |
| 5,441,448 | A * | 8/1995 | Yang | G07D 9/002 206/0.83 |
| 5,722,882 | A | 3/1998 | Kashiwagi et al. | |
| 8,262,441 | B2 * | 9/2012 | Chang | G07D 1/00 453/18 |

FOREIGN PATENT DOCUMENTS

| | | |
|---|---|---|
| DE | 40 27 566 A1 | 3/1992 |
| JP | 8-9812 Y2 | 3/1996 |
| JP | 8-123987 A | 5/1996 |
| JP | 9-293157 A | 11/1997 |
| JP | 2010-146314 A | 7/2010 |

OTHER PUBLICATIONS

International Search Report dated Mar. 31, 2015, in PCT/JP2015/083774, filed Dec. 19, 2014, (1 page).

Extended European Search Report dated Aug. 23, 2018 in European Application No. 14908469.1, filed Dec. 19, 2014 7 pp.

* cited by examiner

*Primary Examiner* — Mark J Beauchaine

(74) *Attorney, Agent, or Firm* — Oblon, McClelland, Maier & Neustadt, L.L.P.

(57) ABSTRACT

A coin tube in which coins falling from an upper side are loaded and stored, the coin tube includes: a coin posture conversion unit, configured to convert a falling posture of a coin, at a coin entry port. The coin posture conversion unit has a shape asymmetric to a center line cl in a progressing direction of the coin on the coin posture conversion unit. The coin tube can suppress generation of coin erection.

4 Claims, 5 Drawing Sheets

[Fig. 1]
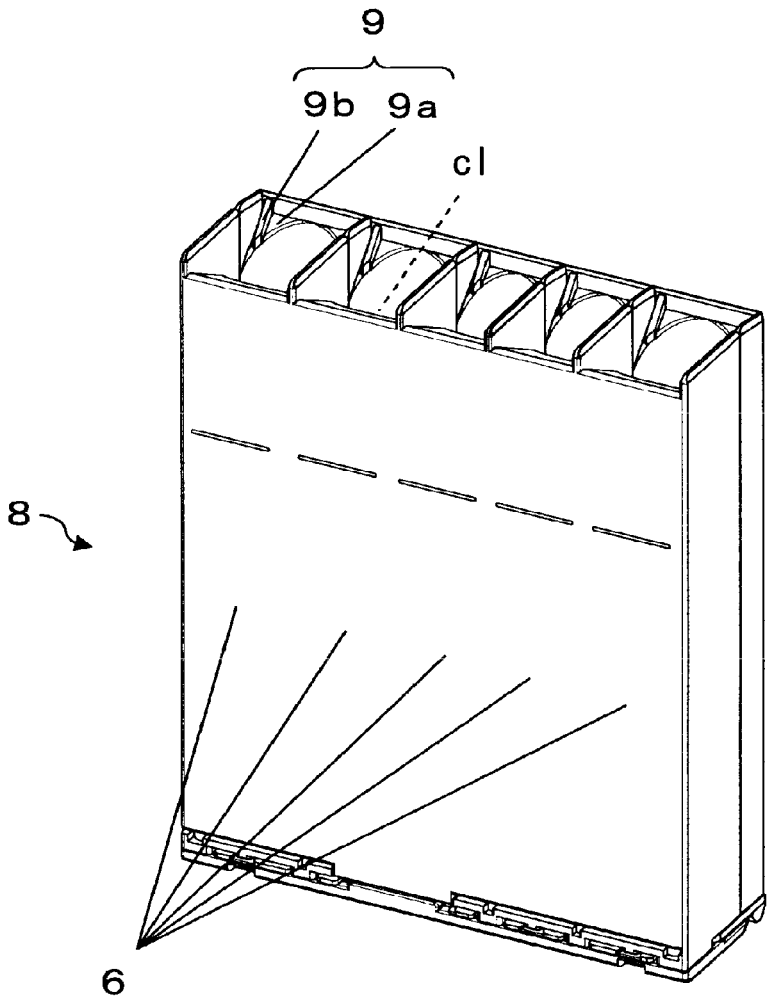

[Fig.2]
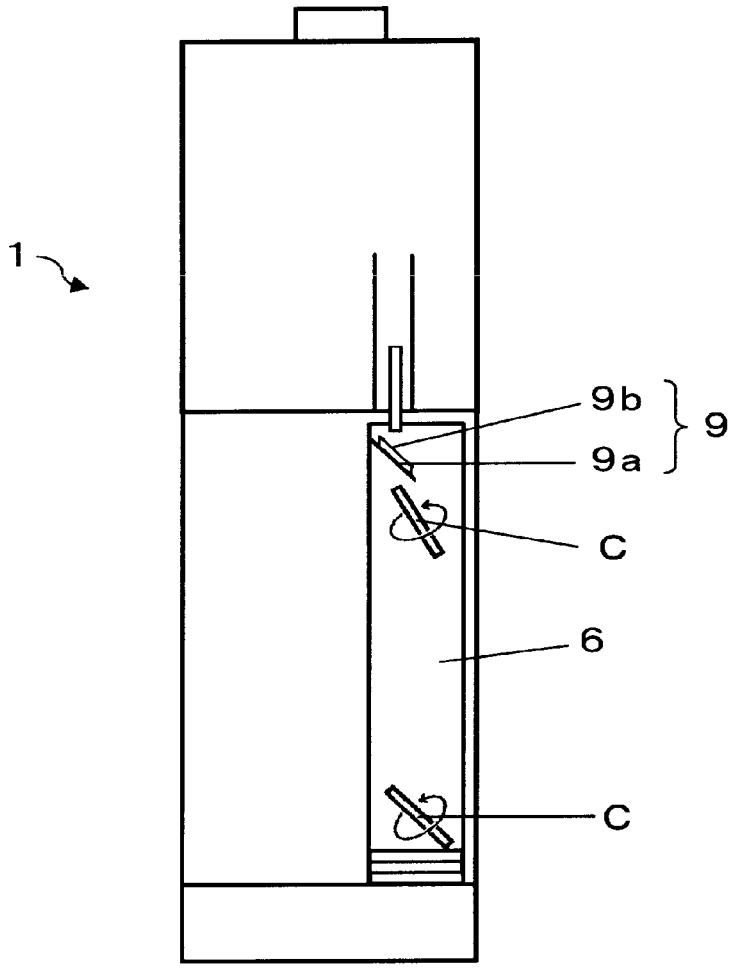

[Fig.3]
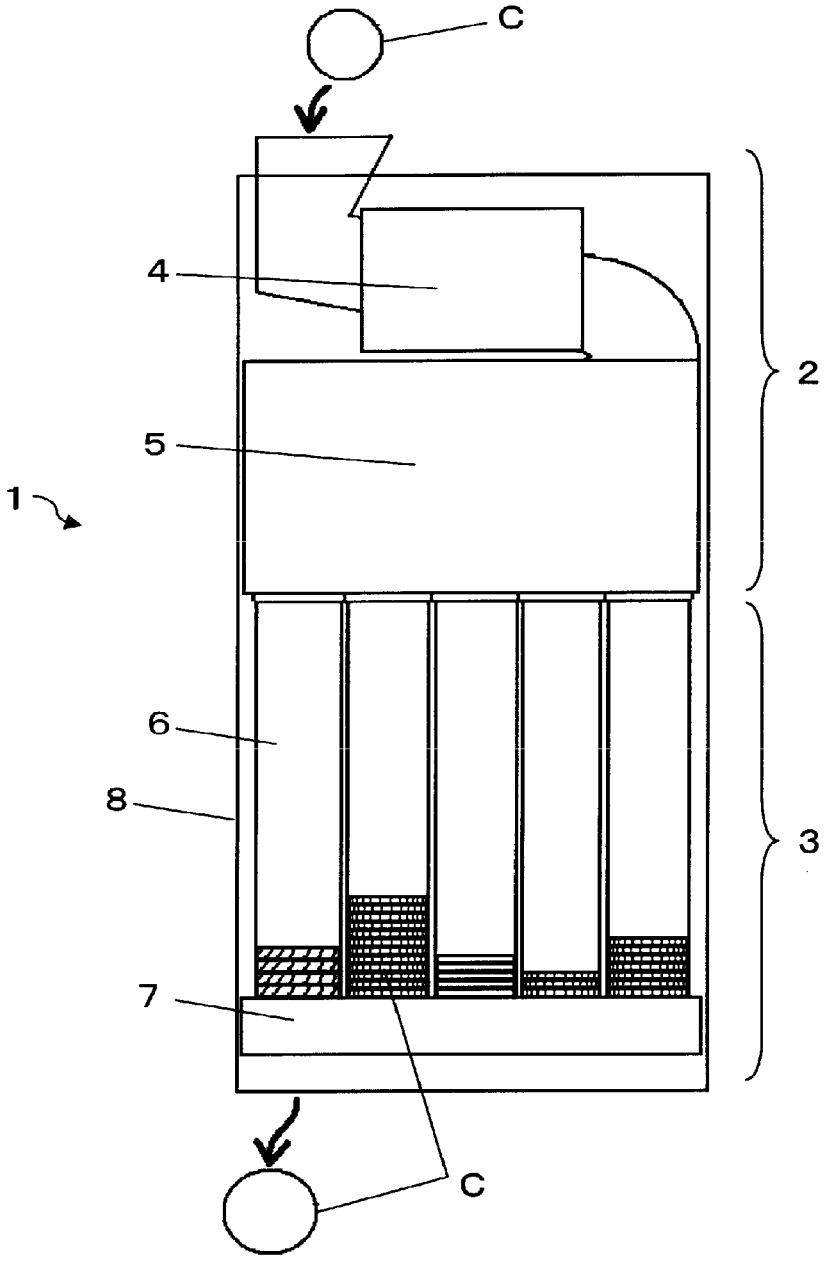

[Fig.4]
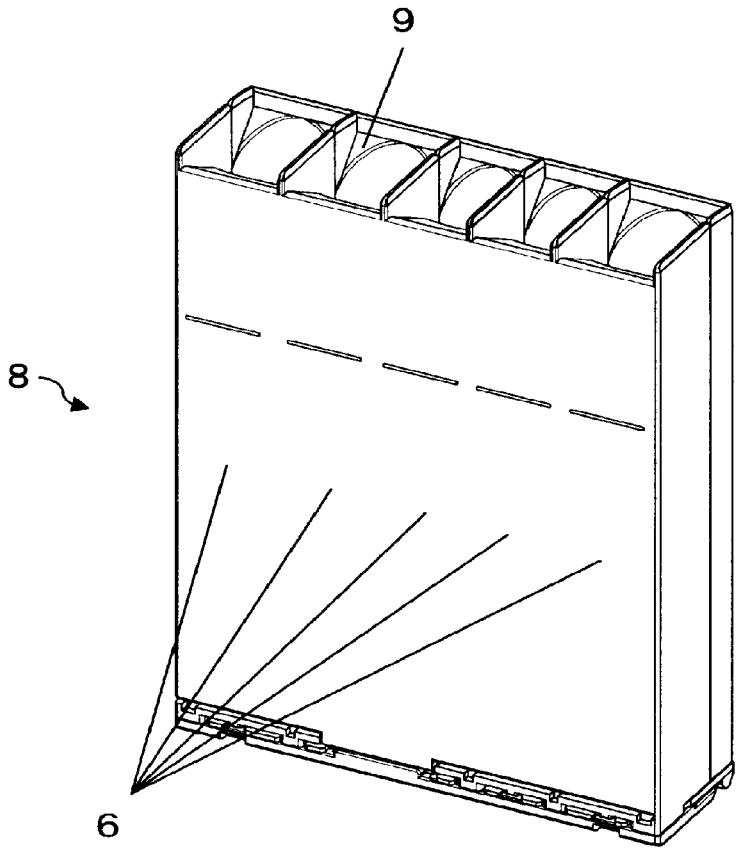

[Fig.5]
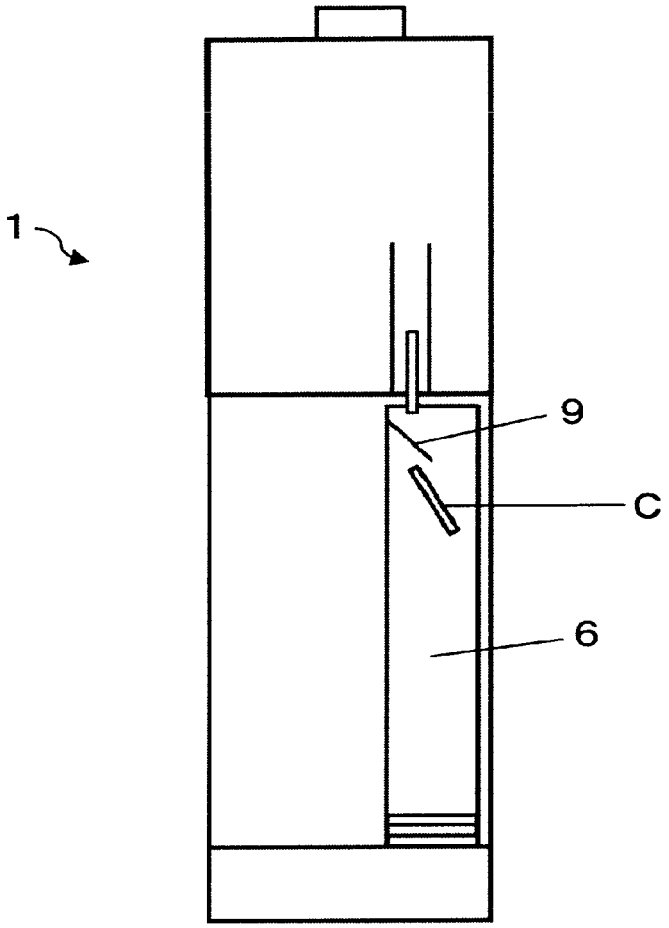

COIN TUBE

TECHNICAL FIELD

The present invention relates to a coin tube of a coin processing device installed in a vending machine, an exchange machine, a fare adjustment machine, a ticket sales machine, a service device or the like (hereinafter referred to as "vending machine or the like").

BACKGROUND ART

Conventionally, a coin processing device, which distinguishes genuineness of inserted coins, sorts and stores the inserted coins that have been determined as genuine coins for each denomination, and further, delivers the coins that have been sorted and stored in response to the amount of change or the like, is installed inside a vending machine or the like. FIG. 3 is a schematic view of such a coin processing device.

A coin processing device 1 is configured mainly of a coin sorting unit 2 to distinguish genuineness of inserted coins and distribute the inserted coins for each denomination, and a coin delivering unit 3 to store the inserted coins that have been distributed by the coin sorting unit 2 for each denomination, and select and deliver coins, from the stored coins, in response to the amount of change or the like. Further, the coin sorting unit 2 includes a coin identification means 4 to distinguish the genuineness and the denomination of the inserted coins and a coin distribution means 5 to distribute coins that have been determined as genuine coins by the coin identification means 4 for each denomination. In addition, the coin delivering unit 3 includes a plurality of coin tubes 6 that stores the coins, which have been distributed for each denomination by the coin sorting unit 2, for each denomination and a coin delivery means 7 to select and deliver coins from the plurality of coin tubes 6 in response to the amount of change or the like. Incidentally, a means, which delivers a coin by pulling out the coins stored in the coin tubes 6 one by one using a slide member referred to as a payout slide from slit-shaped holes opened at lowermost portions of the coin tubes 6, has been widely employed as the coin delivery means.

Further, the plurality of coin tubes 6 are generally provided in a coin storage cassette 8, which is detachable from a main body of the coin processing device 1, to facilitate collection of coins from the coin tube 6 and replenishment of change to the coin tube 6 in the coin delivering unit 3. FIG. 4 is a perspective view of the coin storage cassette 8. The coin storage cassette 8 is formed to be integrated with the plurality of coin tubes 6 arranged in parallel.

In the coin processing device 1, the inserted coin is distributed by the coin distribution means 5 and is stored in the coin tube 6 through natural fall. At this time, when the coin is stored in an erect state, coins are loaded in the coin tube 6 in a misaligned state, and clogging of coins is generated at the time of delivering a coin by the coin delivery means 7, thereby causing failure of the coin processing device 1. In a phenomenon that a coin is erect in the coin tube 6, that is, the phenomenon of so-called coin erection, a coin landing on a bottom surface of the coin tube 6 or on another coin stored in the coin tube 6 is stopped in the state of leaning on an inner-diameter surface of the coin tube 6. This is caused by slide between the bottom surface of the coin tube 6 at a landing point and the coin or slide between coins, and slide between the coin and the inner-diameter surface of the coin tube 6. Examples of elements affecting these slides may include an outer diameter or a thickness dimension of a coin, a coin outer shape, an uneven shape of a pattern of a surface, and the like. A coin having a large thickness hardly falls down since a footprint in the erect state increases. Further, a coin with an erect outer diameter edge or a coin with a significantly uneven pattern also tends to hardly fall down since the slide deteriorates.

In order to suppress generation of such coin erection, the coin tube 6 of the coin processing device 1 of the related art is configured to prevent a coin from entering the coin tube 6 in the state of maintaining a vertical posture by causing the coin to fall from a position deviated from the center of the coin tube 6 to the rear side, as illustrated in FIG. 5. Further, the coin tube 6 of the coin processing device 1 of the related art is configured to provide a plate-shaped coin posture conversion unit 9 for conversion of a posture of a coin into a posture almost horizontal in a coin entry port such that the coin is guided to fall in an inclined posture by the coin posture conversion unit 9 and the coin easily falls down at the time of landing.

CITATION LIST

Patent Literature

Patent Literature 1: JP 2010-146314 A

SUMMARY OF INVENTION

Technical Problem

Since it is difficult to completely prevent generation of the coin erection in the coin tube of the related art, there is a problem that further improvement is required.

The present invention has been made in view of the above-described problem, and an object thereof is to provide a coin tube capable of suppressing generation of coin erection.

Solution to Problem

In order to solve the above-described problem, a coin tube 6 according to claim 1 is a coin tube 6 in which coins falling from an upper side are loaded and stored, the coin tube including: a coin posture conversion unit 9, configured to convert a falling posture of a coin into a posture almost horizontal, at a coin entry port, herein the coin posture conversion unit 9 has a shape asymmetric to a center line cl in a progressing direction of the coin on the coin posture conversion unit 9.

A coin tube 6 according to claim 2 is the coin tube 6 according to claim 1, wherein the coin posture conversion unit 9 includes a plate-shaped member 9*a* provided with a rib-like protrusion 9*b*, the rib-like member 9*b* is provided only at one side between both sides in the center line cl in the progressing direction of the coin on the coin posture conversion unit 9 or the rib-like members with different heights are provided, respectively, at both the sides in the center line cl in the progressing direction of the coin on the coin posture conversion unit 9.

A coin storage cassette 8 according to claim 3 is a coin storage cassette 8 which is formed to be integrated with a plurality of coin tubes 6 arranged in parallel, wherein at least one of the plurality of coin tubes 6 is the coin tube 6 according to claim 1 or 2.

Advantageous Effects of Invention

According to the present invention, it is possible to suppress generation of the coin erection.

BRIEF DESCRIPTION OF DRAWINGS

FIG. 1 is a front-side perspective view of a coin storage cassette provided with a coin tube according to an embodiment of the present invention.

FIG. 2 is a side cross-sectional view of a main part of a coin processing device illustrating a state where coins are stored in the coin tube according to the embodiment of the present invention.

FIG. 3 is a front schematic view of a coin processing device of the related art.

FIG. 4 is a front-side perspective view of a coin storage cassette provided with a coin tube of the related art.

FIG. 5 is a side cross-sectional view of a main part of the coin processing device illustrating a state where coins are stored in the coin tube of the related art.

DESCRIPTION OF EMBODIMENTS

Hereinafter, one of embodiments of the present invention will be described with reference to the drawings.

FIG. 1 is a front-side perspective view of a coin storage cassette 8 which is provided with a coin tube 6 according to an embodiment of the present invention, and FIG. 2 is a side cross-sectional view of a main part illustrating a state where coins are stored in the coin tube 6 according to the embodiment of the present invention. Structures of the coin storage cassette 8 and the coin tube 6 according to the embodiment are the same as structures of a coin storage cassette 8 and a coin tube 6 of the related art, which have been described above, except for parts to be described hereinafter. Accordingly, members among components in this embodiment that are equivalent to the components of the above-described coin tube 6 of the related art will be denoted by the same reference signs, and the detailed description thereof will be omitted.

This coin tube 6 assumes that a coin enters the coin tube 6 from a position deviated from the center of the coin tube 6 to the rear, which is similar to the coin tube 6 of the related art. This coin tube 6 is provided with a coin posture conversion unit 9 including a plate-shaped member 9*a* on an inner wall surface of a coin entry port. This coin posture conversion unit 9 including the plate-shaped member is provided on the inner wall surface, which is on a side close to an entry point of the coin, in order to guide the entering coin and is inclined to the lower side. In addition, the plate-shaped member 9*a* of the coin posture conversion unit 9 has a shape provided with a semicircular cut in order to cause the coin whose posture has been converted by the coin posture conversion unit 9 to fall without being stuck.

The coin entering the coin tube 6 abuts on an inner wall of the coin tube 6 and the coin posture conversion unit 9, and a progressing posture thereof is converted into a posture almost horizontal as falling to slide along an inclination of the coin posture conversion unit 9. Thereafter, the progressing posture of the coin falling inside the coin tube 6 is further changed as colliding with the inner wall of the coin tube 6, and generally becomes further close to the horizontal posture at the time of reaching a bottom of the coin tube 6. In general, coin erection is not generated in a case where a coin reaches a bottom surface of the coin tube 6 or a top surface of a stored coin in a posture almost horizontal since the coin erection is generated in the coin tube 6 when a coin reaches the bottom of the coin tube 6 or a top surface of a stored coin in a posture almost vertical. However, it is difficult to manage or control a posture of a coin in the middle of falling in the coin tube 6, and thus, a posture of each coin falling on the top of the stored coin varies depending on the number of coins stored in the coin tube 6.

Thus, not only the plate-shaped member 9*a* guiding the coin but also a rib-like protrusion 9*b* is provided in the coin posture conversion unit 9 of the coin tube 6. The rib-like protrusion 9*b* is configured to cause an inclination in a direction vertical to an inclination, which is caused by the inner wall near the coin entry port of the coin tube 6 and the plate-shaped member 9*a*, in addition to the latter inclination. Thus, the rib-like protrusion 9*b* is provided only at one side between both sides of a center line cl in a progressing direction of a coin on the coin posture conversion unit 9, in the plate-shaped member 9*a* of the coin posture conversion unit 9.

Since the rib-like protrusion 9*b* is present, the coin that has entered the coin tube 6 and abutted on the coin posture conversion unit 9 gently rotates in the direction vertical to the inclination caused between the inner wall near the coin entry port and the plate-shaped member 9*a* due to the momentum of free fall and the inclination caused by the rib-like protrusion 9*b*. As a result, an inertial force for rotation in a transverse direction works on the coin falling in the coin tube 6. Further, even when the coin having such an inertial force lands on the bottom surface of the coin tube 6 or the top surface of the stored coin in the posture almost vertical, the coin hardly maintains the posture at the time of landing due to the inertial force. Thus, it is possible to suppress generation of the coin erection due to the presence of the rib-like protrusion 9*b*.

As described above, the coin tube 6 includes the coin posture conversion unit 9, which converts the posture of the coin into the posture almost horizontal, at the coin entry port, and further, the coin posture conversion unit 9 applies a rotational force in a direction vertical to the progressing direction to the coin on the coin posture conversion unit 9. This application of the rotational force can be implemented by forming the coin posture conversion unit 9 in a shape asymmetric to the center line cl in the progressing direction of the coin on the coin posture conversion unit 9. In the coin tube 9, the coin posture conversion unit 9 is formed in the asymmetric shape by providing the rib-like protrusion 9*b* only at one side between both sides of the center line cl in the progressing direction of the coin on the coin posture conversion unit 9. As another configuration, it is possible to consider a configuration in which rib-like protrusions having different heights are provided, respectively, at both the sides in the center line cl in the progressing direction of the coin on the coin posture conversion unit 9, a configuration in which the plate-shaped member 9 is directly caused to be inclined laterally instead of providing the rib-like protrusion, and the like.

According to the coin tube 6 according to the above-described embodiment is capable of suppressing generation of the coin erection more than the coin tube of the related art.

Although one of the embodiments of the present invention has been described as above, the coin tube of the present invention is not limited to the embodiment. It is possible to adopt a suitable configuration as long as satisfying the configurations described in the claims.

REFERENCE SIGNS LIST

1 coin processing device
2 coin sorting unit

3 coin delivering unit
4 coin identification means
5 coin distribution means
6 coin tube
7 coin delivery means
8 coin storage cassette
9 coin posture conversion unit
C coin

The invention claimed is:

1. A coin tube in which coins falling from an upper side are loaded and stored, the coin tube comprising:

a coin posture guide to convert a falling posture of a coin into a substantially horizontal posture, at a coin entry port, wherein the coin posture guide has a shape asymmetric to a center line in a progressing direction of the coin on the coin posture guide and includes a plate-shaped member provided with a rib-like protrusion, the rib-like protrusion is provided only at one side between both sides in the center line in the progressing direction of the coin on the coin posture guide or the rib-like protrusion with different heights are provided, respectively, at both the sides in the center line in the progressing direction of the coin on the coin posture guide, and the coin tube is configured to be included in a coin processing device installed in a vending machine.

2. A coin storage cassette which is formed to be integrated with a plurality of coin tubes arranged in parallel, wherein at least one of the plurality of coin tubes is a coin tube in which coins falling from an upper side are loaded and stored, the coin tube comprising:

a coin posture guide to convert a falling posture of a coin into a substantially horizontal posture, at a coin entry port, wherein the coin posture guide has a shape asymmetric to a center line in a progressing direction of the coin on the coin posture guide and includes a plate-shaped member provided with a rib-like protrusion, the rib-like protrusion is provided only at one side between both sides in the center line in the progressing direction of the coin on the coin posture guide or the rib-like protrusion with different heights are provided, respectively, at both the sides in the center line in the progressing direction of the coin on the coin posture guide, and the coin tube is configured to be included in a coin processing device installed in a vending machine.

3. A coin tube of a coin processing device, in which coins falling from an upper side are loaded and stored, the coin tube comprising:

a coin posture guide positioning a falling posture of a coin into a substantially horizontal posture, at a coin entry port, wherein the coin posture guide has an inner wall surface shape asymmetric to a center line of a cross-section of the coin tube, and the inner wall surface is in a progressing direction of the coin on the coin posture guide and includes a plate-shaped member provided with a rib-like protrusion, and the rib-like protrusion is provided only at one side between both sides in the center line in the progressing direction of the coin on the coin posture guide or the rib-like protrusion with different heights are provided, respectively, at both the sides in the center line in the progressing direction of the coin on the coin posture guide.

4. A coin storage cassette which is formed to be integrated with a plurality of coin tubes arranged in parallel, wherein at least one of the plurality of coin tubes is the coin tube of a coin processing device, in which coins falling from an upper side are loaded and stored, the coin tube comprising:

a coin posture guide positioning a falling posture of a coin into a substantially horizontal posture, at a coin entry port, wherein the coin posture guide has an inner wall surface shape asymmetric to a center line of a cross-section of the coin tube, and the inner wall surface is in a progressing direction of the coin on the coin posture guide and includes a plate-shaped member provided with a rib-like protrusion, and the rib-like protrusion is provided only at one side between both sides in the center line in the progressing direction of the coin on the coin posture guide or the rib-like protrusion with different heights are provided, respectively, at both the sides in the center line in the progressing direction of the coin on the coin posture guide.

* * * * *